US006999868B2

(12) United States Patent
Funke et al.

(10) Patent No.: US 6,999,868 B2
(45) Date of Patent: Feb. 14, 2006

(54) DIAGNOSTIC TEST FOR VARIABLE VALVE MECHANISM

(75) Inventors: Steven J. Funke, Mapleton, IL (US); Jason K. Bloms, Peoria, IL (US); Troy A. Parker, Chillicothe, IL (US); Mark J. Hilbert, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/732,723

(22) Filed: Dec. 10, 2003

(65) Prior Publication Data

US 2005/0126524 A1 Jun. 16, 2005

(51) Int. Cl.
*G06G 7/70* (2006.01)

(52) U.S. Cl. ..... 701/114; 701/103; 701/105; 73/117.3; 73/118.1; 123/90.11; 123/90.15

(58) Field of Classification Search ..... 701/103, 701/105, 114; 73/117.3, 118.1; 123/295, 123/305, 395, 396, 397, 398, 90.11, 90.15
See application file for complete search history.

(56) References Cited

U.S. PATENT DOCUMENTS 4,648,903 A * 3/1987 Ikenoue et al. ..... 75/230
5,205,152 A 4/1993 Clarke et al.
5,261,373 A 11/1993 Ohsuga et al.
5,327,090 A 7/1994 Shimasaki et al.
5,636,620 A 6/1997 Kiess et al.
6,006,157 A 12/1999 Dai et al.
6,047,674 A 4/2000 Kadowaki et al.
6,085,706 A 7/2000 Kadowaki et al.
6,112,765 A 9/2000 Boyer
6,257,184 B1 7/2001 Yamagishi et al.
6,336,440 B1 1/2002 Schmitz et al.
6,338,329 B1 1/2002 Maegawa et al.
6,363,314 B1 3/2002 Hafner et al.
6,526,745 B1 * 3/2003 Ogiso ..... 60/285
6,763,707 B1 * 7/2004 Kumagai et al. ..... 73/117.3

* cited by examiner

*Primary Examiner*—Tony M. Argenbright
*Assistant Examiner*—Johnny H. Hoang
(74) *Attorney, Agent, or Firm*—Liell & McNeil

(57) ABSTRACT

Having the ability to quickly and easily test whether a variable valve mechanism is operating properly can avoid unnecessary down time and the expense associated with potentially replacing a good component on an internal combustion engine. A test can include inducing a misfire in a cylinder of the engine at least in part by commanding a change to a state of a variable valve mechanism at a predetermined timing. For instance, in the case of a diesel engine, a variable valve mechanism can be tested by closing an intake valve late so as to reduce a cylinder compression ratio to a point that autoignition of fuel does not occur, resulting in a misfire. If a misfire is detected, either audibly by a person or possibly electronically via a sensor, then proper activation of the variable valve mechanism is confirmed.

18 Claims, 3 Drawing Sheets

DIAGNOSTIC TEST FOR VARIABLE VALVE MECHANISM

TECHNICAL FIELD

The present invention relates generally to testing variable valve mechanisms that are installed on an internal combustion engine, and more particularly to inducing a misfire using the variable valve mechanism to determine if the variable valve mechanism is operating properly.

BACKGROUND

Fixed timing cam actuated gas exchange valves for internal combustion engines are beginning to give way to structures that allow for some timing variation in either the opening or closing timing of either, or both of, an intake valve and an exhaust valve. These mechanisms include, but are not limited to, devices that can adjust the phase angle of a cam relative to the crank shaft, mechanisms with the ability to hold a valve open beyond its normal cam dictated closing timing, and possibly even camless actuators, such as an electro-hydraulic actuator, that enable complete control over valve opening and closing timing independent of crank shaft angle. Those skilled in the art have long recognized that the ability to vary valve timing can allow for performance improvements, reduced emissions, and oftentimes both.

Like any engine component, a variable valve mechanism can fail. Oftentimes an engine can be equipped with electronic fault detection algorithms in its electronic control module for monitoring various engine components for failure, including variable valve actuators. If a fault is detected, the operator is often notified via an indicator light or the like instructing them to seek servicing of the engine. It is known that fault detectors can sometimes issue a false positive. In such a case, a fault notification can cause an operator to have a variable valve actuator mistakenly replaced when it is actually working properly. Thus, a false positive in a fault detection algorithm can lead to unnecessary down time along with the substantial expense associated with replacing a good component. Apart from this problem, there are often difficulties in quickly confirming that a newly installed or replaced variable valve actuator is operating properly.

The present invention is directed to one or more of the problems set forth above.

SUMMARY OF THE INVENTION

In one aspect, a method of testing a variable valve mechanism is performed on an operating internal combustion engine. A misfire is induced at least in part by commanding a change to a state of a variable valve mechanism at a predetermined timing. Then, detect whether a misfire occurred.

In another aspect, an electronic control module for an internal combustion engine includes a variable valve mechanism testing algorithm recorded on a computer readable data storage medium. The testing algorithm includes an engine cylinder misfire detection algorithm.

In still another aspect, a machine includes an engine mounted on a chassis. The engine is equipped with at least one variable valve mechanism. A means for testing the variable valve mechanism includes a means for inducing an engine cylinder misfire.

DETAILED DESCRIPTION

Figure 1:
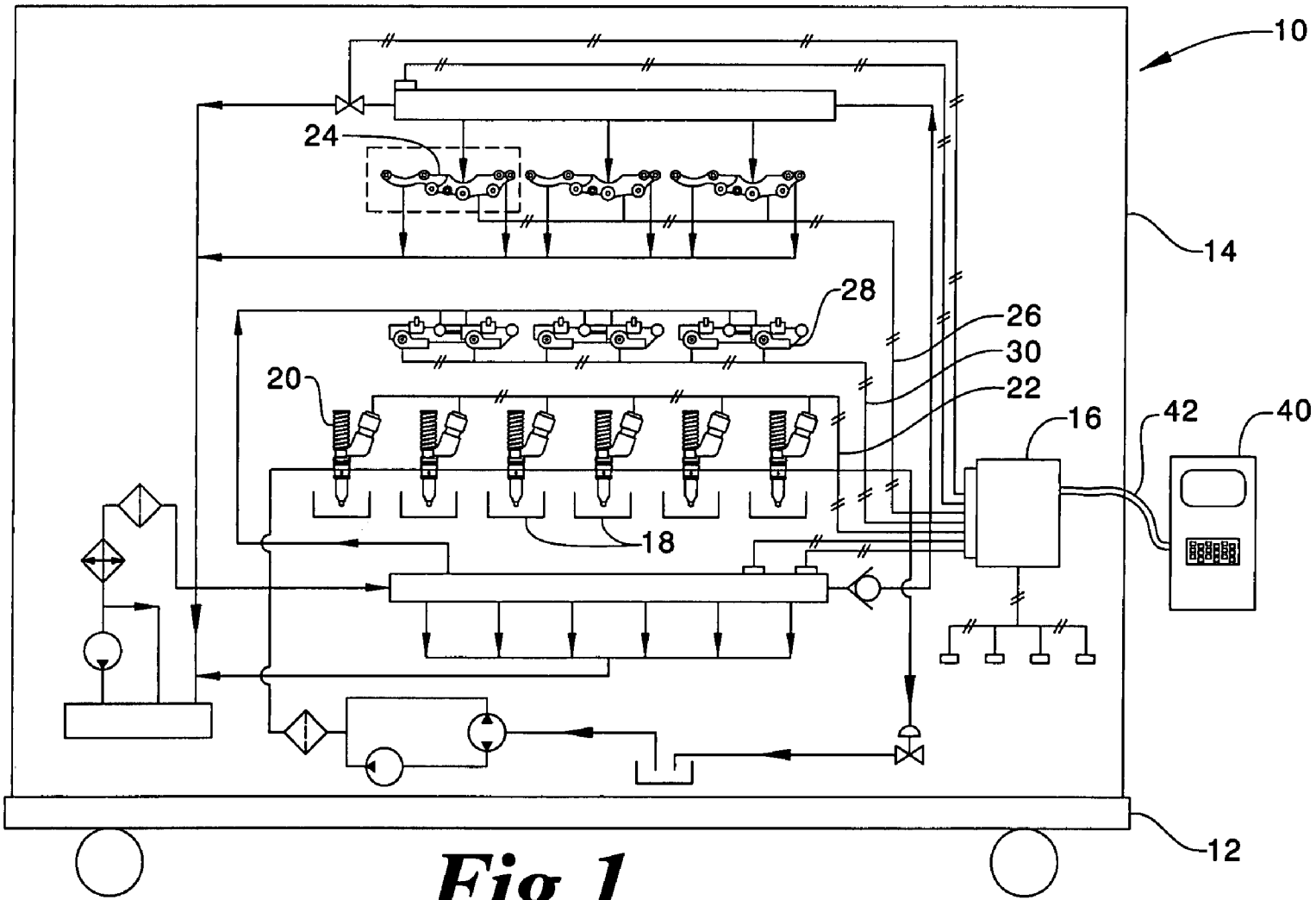
FIG. 1 is a schematic illustration of a machine having an engine equipped with a variable valve mechanism according to the present invention.

Referring now to FIG. 1, a vehicle 10, such as an on road truck or an off road work machine, includes an engine 14 mounted on a chassis 12. Engine 14 is preferably a multi cylinder compression ignition engine, but could be any multi cylinder engine including but not limited to a spark ignition gasoline engine or a gaseous fuel engine. In the illustrated embodiment, engine 14 includes six engine cylinders 18 and a single electronically controlled fuel injector 20 associated with each engine cylinder. Each cylinder 18 is also associated with variable timing intake valve actuators 24 and electro-hydraulically actuated exhaust valves 28. Engine 14 and its sub-systems, including fuel injectors 20, intake valve actuators 24 and exhaust valve actuators 28, are controlled in a conventional manner via an electronic control module 16 via communication lines 22, 26 and 30, respectively. Although the engine 14 of the illustrated embodiment includes intake and exhaust valve mechanisms that allow for some variable valve timing, the present invention also contemplates engines in which only the intake or exhaust valves have an electronically controlled variable valve timing capability. FIG. 1 also shows an external servicing computer 40 in communication with electronic control module 16 via a communication line 42. Depending upon how the invention is implemented, the external servicing computer can be optional. In other words, the software necessary for carrying out the tests according to the present invention can be completely carried by the electronic control module 16, can be carried by the servicing computer 40 which overrides control of engine 14, or by some combination of the two and/or via a manual operation by an operator or engine technician.

The present invention is potentially applicable to any engine with some electronically controlled variable valve timing capability. Those skilled in the art will appreciate that variable valve timing can be accomplished in a wide variety of ways, all of which could be suitable with the present invention. In the illustrated embodiment, engine 14 is equipped with electro-hydraulically actuated exhaust valve actuators that are sufficiently powerful to open exhaust valves at or near peak compression pressure to perform engine compression release braking. These powerful actuators are well known in the art and give the electronic control module the ability to open the exhaust valves at virtually any timing during engine operation. Thus, the electro-hydraulic exhaust valve mechanisms enable the engine to perform engine compression release braking when the engine is in a braking mode, and allow various other engine strategies when in power mode, including but not limited to exhaust gas recirculation, as well as advancing and/or retarding exhaust valve opening and closing timings. In the illustrated embodiment, the intake valves are generally cam actuated, but include an electronically controlled variable valve closing mechanism that allows the intake valve's closing timing to be retarded beyond a cam dictated intake valve closing timing. Thus, in the illustrated embodiment, electronic control over the intake valves is substantially more limited than that of the exhaust valve actuators. Thus, the present invention contemplates engines equipped with intake and exhaust valve actuators with differing capabilities, as long as both are electronically controlled. In addition, the present invention contemplates engines in which only one of the exhaust valves or intake valves have some variable valve timing capability.

Figure 2:
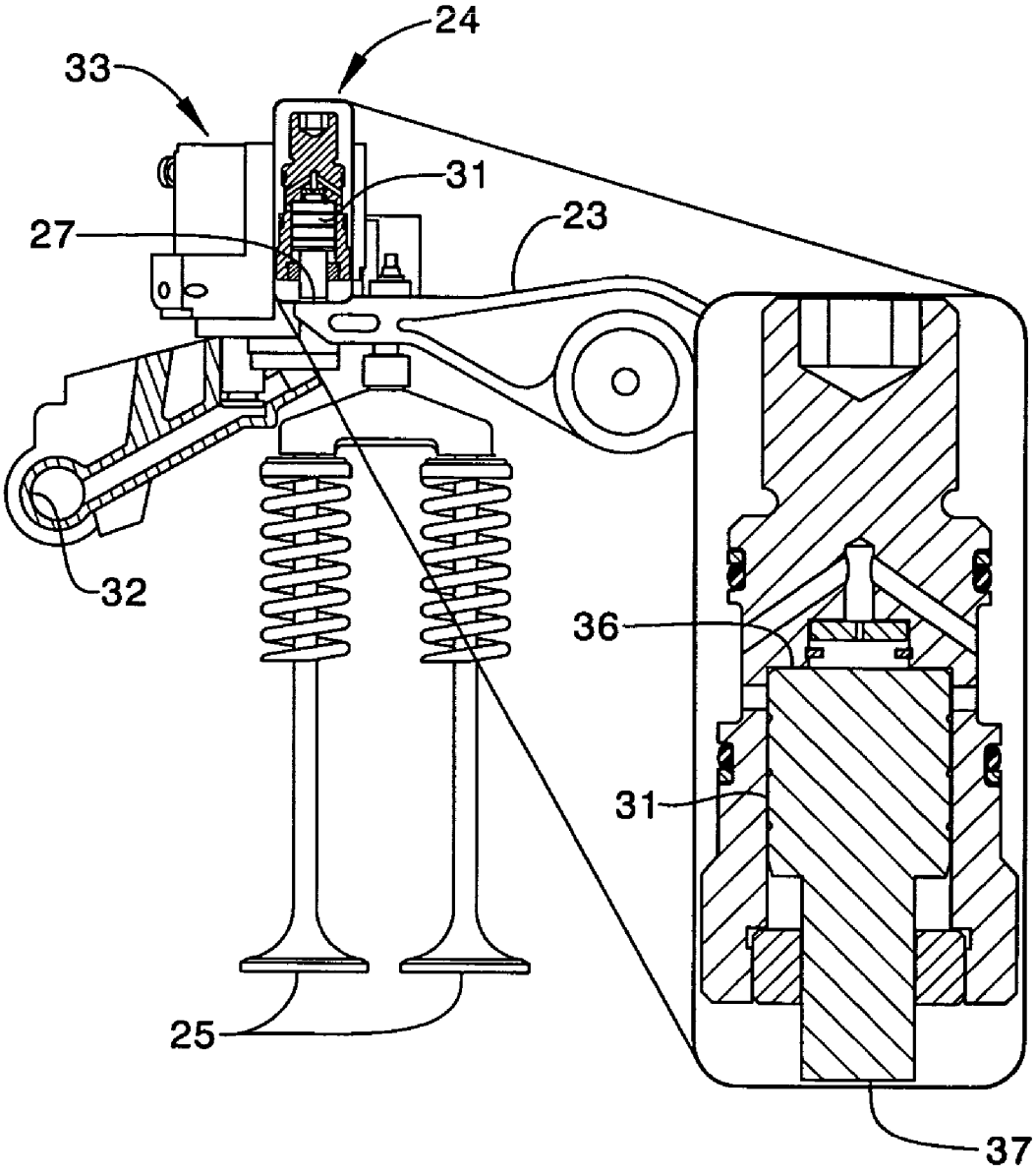
FIG. 2 is a diagrammatic illustration of an intake valve actuating mechanism for the engine shown in FIG. 1.

Referring now to FIG. 2, the inner workings of the example intake valve actuators 24 for engine 14 are illustrated. Generally, intake valves 25 are opened and closed at regular predetermined timings via a cam operably coupled to rocker arm 23 in a conventional manner. Thus, intake valve actuator 24 can have regular cam dictated valve opening and closing timings. However, intake valve actuator 24 also includes a hydraulically actuated piston 31 that includes a contact surface 37 that can contact end 27 of rocker arm 23 to maintain intake valves 25 in an at least partially open position beyond a normally cam dictated closing timing. Piston 31 includes a hydraulic surface 36 that can be acted upon by relatively low pressure fluid from a common rail 32. In the illustrated embodiment, the fluid pressure acting on piston 31 is insufficiently powerful to open intake valves 25 on its own. Nevertheless, the present invention does contemplate electronically controlled intake valve actuators with sufficient power to open the intake valves at virtually any timing. When in operation, the cam causes rocker arm 23 to move downward to open intake valves 25 at a normal valve opening timing. While the intake valves 25 are open, relatively low pressure fluid from rail 32 acts upon hydraulic surface 36 moving piston 31 downward. Next, the fluid acting on piston 31 is isolated by closing a fluid control valve 33 via an electrical actuator. As the cam continues to rotate, the rocker arm begins to close intake valve; however, the rocker arm becomes decoupled from the cam when end 27 contacts surface 37 of piston 31, which holds the intake valves at a partially open position, such as several millimeters of lift. Because of fluid acting on hydraulic surface 36 is isolated, the piston 31 becomes hydraulically locked and the intake valves 25 remain open beyond their normal cam dictated valve closing timings. At the desired valve closing timing, control valve 33 is opened via an electrical actuator controlled by the electronic control module 16 (FIG. 1) to allow the fluid acting on hydraulic surface 36 to escape back to common rail 32. The return spring associated with intake valves 25 then cause the valves to move to a closed position while piston 31 retracts. In the illustrated embodiment, the electrical actuator associated with control valve 33 is normally biased open. Thus, to achieve a valve closing time beyond the normal cam dictated valve closing timing, the electrical actuator associated with control valve 33 must be energized throughout the extended valve opening. Depending upon the electrical capacity of electronic control module 16, there may not be enough electrical energy available to hold control valve 33 open indefinitely while still performing necessary electrical functions associated with other engine cylinders and engine actuator components.

Although the various mechanisms for accomplishing some variable valve timing have proven reliability, there remains issues as to the difficulty in ascertaining whether all the actuators in a given engine are working properly, especially when the engine is installed in a vehicle. The present invention provides a straight forward methodology for diagnosing problems associated with one or more variable valve actuators. In order to ascertain whether a particular variable valve actuator for a particular cylinder is operating properly, the present invention contemplates a method by which the normal operating commands of the engine issued from the electronic control module are overridden to induce a misfire in the cylinder being tested. The misfire is induced by commanding a variable valve mechanism or actuator to change its actuation state in such a way that the compression ratio in that cylinder is so undermined as to prevent autoignition when fuel injection occurs at or near top dead center of the engine piston.

As used in this patent document, the term misfire means that the particular cylinder receives fuel in a particular engine cycle but fails to produce the power in that cycle. Thus, this necessarily implies that the present invention contemplates the engine running when the diagnostic test according to the present invention is performed. Those skilled in the art will recognize that there are many ways known in the art to detect a misfire in an engine, and any of those methods would be suitable for use in relation to the present invention. For instance, many engine technicians can detect a misfire without any sophisticated instrumentation via sensing a vibration through touch and/or hearing a misfire due to an audible change in an engine's acoustic output when one cylinder is misfiring. In addition, many engines are operated in a way that they are commanded by their electronic control module to maintain a predetermined speed. In this type of engine, a misfire can be detected when the electronic control module commands a substantial increase in fuel injection quantity to the powered cylinders to make up for the lost power from the misfiring cylinder and maintain the engine at the predetermined speed. Thus, another potential method of detecting a misfire includes monitoring the fuel injection quantity for individual fuel injectors while the engine is commanded to maintain a given RPM. This method of detecting a misfire is particularly well suited to an electronic detection means since fuel injection quantity data are already available to the electronic control module during the normal operation of a given engine.

In general, if one cylinder is misfiring in a six cylinder engine, one could expect the fuel injectors for the five powered cylinders to inject about 20% more fuel than normal in order to maintain the engine at a given speed. Although the present invention could be accomplished with such a strategy, the present invention also contemplates commanding the engine to operate on less than all cylinders, and then performing an induced misfire to further lessen the likelihood of a misdiagnosis due to sensitivity in determining whether the powered fuel injectors are actually injecting substantially more fuel. For instance, the present invention contemplates commanding the engine to operate on only three cylinders and allow the engine to reach a steady state condition over several seconds. In such a case, one can initially expect each of the powered fuel injectors to be injecting about twice as much as they normally would in order to maintain the engine at a given speed. Next, if the electronic control module (or servicing computer) commands the initiation of the test according to the present invention by inducing a misfire in one of the remaining three cylinders, one could expect a substantial increase in fuel required to maintain the engine at a given speed with only two cylinders being powered. In fact, one could expect to observe the two remaining powered fuel injection cylinders to increase their injection amounts by about 50% over that which was required to maintain the engine speed when three cylinders were powered. Thus, a more profound increase in fuel injection quantity in the remaining powered cylinders should be more easy to detect, and hence confirm whether a misfire has actually occurred.

The present invention also contemplates and addresses engine systems in which system limitations prevent inducement of a misfire through only manipulation of a variable valve timing event(s). For instance, the electrical power available may prevent an intake valve closing timing to be retarded so substantially as to prevent autoignition when fuel is injected at or near top dead center. For instance, there simply may not be enough electrical power available to hold an intake valve open beyond about 100° before top dead center. In these instances, it may also be necessary to retard injection timing in the cylinder being tested in order to induce a misfire. Thus, in those cases where a manipulated variable valve timing event at its extreme is still insufficient to induce a misfire, the injection timing for that cylinder can be retarded sufficiently to aid in inducing a misfire. Nevertheless, those skilled in the art will appreciate that the commanded retarding of injection timing should be insufficient by itself to cause a misfire. Thus, if the variable valve actuator for the particular cylinder is not working properly such that the intake valve closes at its normal cam dictated valve closing timing, a misfire in that cylinder will not occur simply due to a retarding of injection timing for that cylinder. In the case of the intake valve actuator illustrated in FIG. 2 in the engine of FIG. 1, a combined injection retarding timing of about 5° combined with commanding the longest possible retarded timing for the intake valve closing event (about 105° before top dead center) is required to induce a misfire. Nevertheless, those skilled in the art will appreciate that, depending upon the particular system, different valving events could be created. For instance, if the electro hydraulically actuated exhaust valves were being tested, one could induce a misfire by retarding exhaust valve closing timing so substantially that the exhaust valve does not close until well into the compression stroke, such that compression ratio is so undermined that autoignition of fuel injected does not occur, creating a misfire. Another alternative might be to simply command the exhaust valve actuator to open the exhaust valve over a portion of the compression stroke sufficient to undermine compression ratio to the point that a misfire will occur in that cylinder.

Those skilled in the art will appreciate that during normal engine operation, the electronic control module receives various sensor inputs and calculates a desired injection quantity and timing based upon these inputs. In the preferred method of the present invention, the vehicle is stationary, and the engine is commanded to maintain a fixed RPM, such as 1000 RPM during the testing mode. The invention could be implemented by completely or partially overriding the normal electronic control module operation in controlling the engine. For instance, the test could be accomplished simply by overriding the control signals associated with a single cylinder while the electronic control module continues to calculate control signals for the other cylinders in a conventional manner. Alternatively, all of the control signals for all of the cylinders could be produced in a completely separate test software subroutine loaded in the electronic control module and/or a diagnostic computer operably connected to the engine, as shown in FIG. 1. Thus, those skilled in the art will appreciate that the methodology of inducing a misfire while operating the engine can be implemented in a wide variety of ways without departing from the intended scope of the present invention.

INDUSTRIAL APPLICABILITY

The present invention finds potential applicability to any engine equipped with an electronically controlled variable valve timing capability in association with either the intake valves, the exhaust valves, or both. In a preferred application, both a servicing computer and an electronic control module for a particular engine include a conventional computer readable data storage medium that includes a variable valve mechanism testing algorithm according to the present invention. The testing algorithm in the case of the engine of FIG. 1 would include an engine cylinder misfire detection algorithm, an intake valve closing timing retarding algorithm, and a fuel injection timing retarding algorithm. The misfire detection algorithm could include an injection quantity increase detection algorithm as discussed earlier, or possibly be linked to an acoustic or vibration sensor. In addition, the present invention contemplates a test result recording algorithm so that the results of the diagnostic test can be recorded and/or displayed to a technician and/or the vehicle operator.

Figure 3:
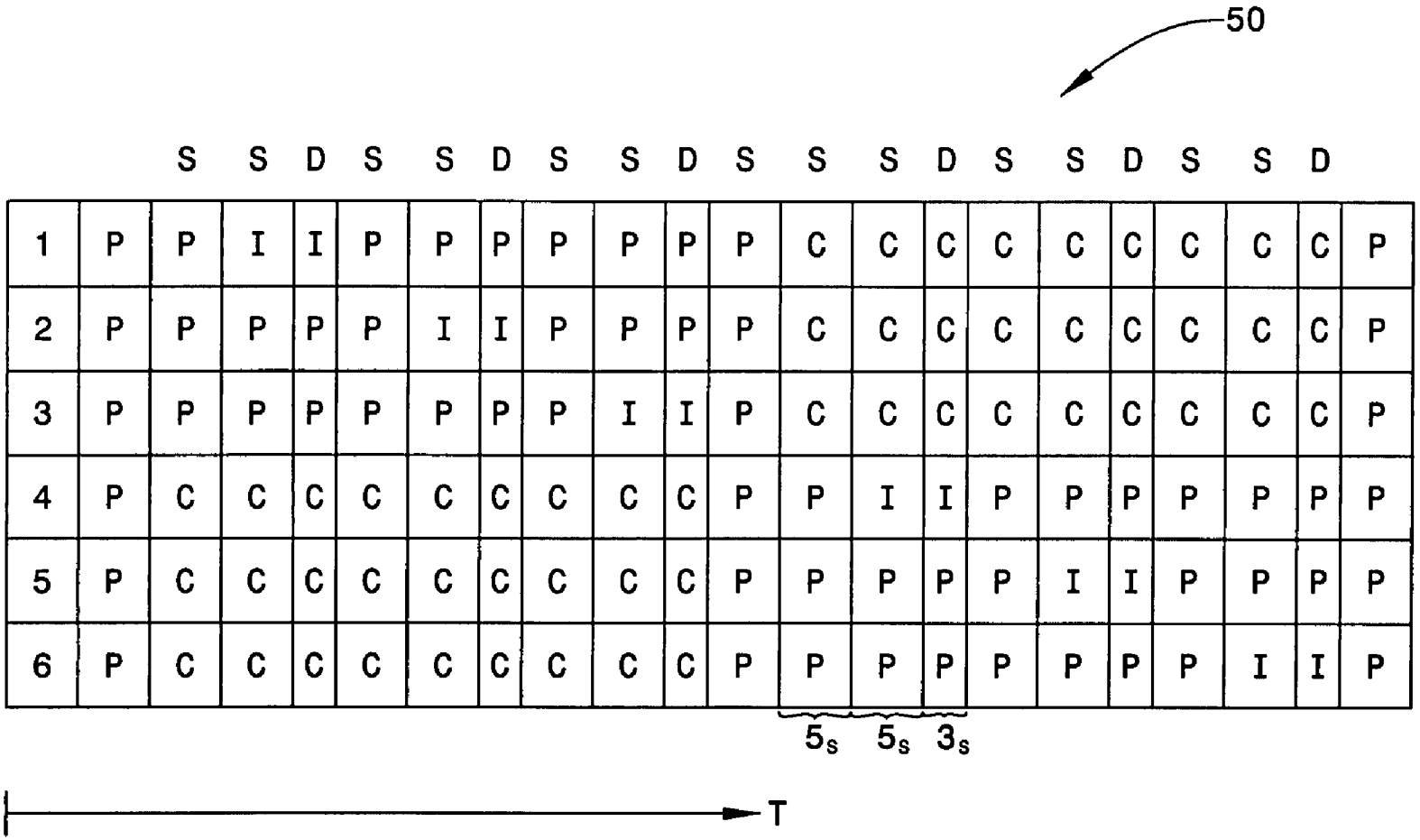
FIG. 3 is a diagram of a diagnostic testing procedure according to the present invention.

Referring now to FIG. 3, a grid shows one proposed strategy for carrying out the diagnostic test according to the present invention sequentially on all six cylinders of the engine of FIG. 1. In the testing strategy 50 shown in FIG. 3, the numerals in the first column refer to the individual engine cylinders by number. The letter "P" refers to that cylinder being powered for that increment of time, which runs horizontally from left to right in the grid. In this example embodiment, the duration of each square box in the grid is about five seconds, whereas the thinner rectangular boxes represent a three second duration. Nevertheless, those skilled in the art will appreciate that a wide variety of different durations could be used to accomplish the same result. The letter "C" represents a command to cut off fuel injection for that cylinder. The letter "S" represents that the engine is allowed to settle to a steady state over the five seconds devoted to that particular column. The letter "I" represents an indication of the intake valve actuator being tested on that particular cylinder. The letter "D" represents that data is being sensed and recorded over that three second duration.

When the variable intake valve mechanism testing algorithm is initiated, the engine is operating on all six cylinders as illustrated by the second column in the grid 50 of FIG. 3. In the next step, the testing algorithm cuts out cylinders 4, 5 and 6, and commands the remaining cylinders 1, 2 and 3 to remain in a powered mode and maintain the engine at a particular speed, such as 1000 RPM. The engine is allowed to settle over about five seconds, or whatever time period is desired or needed. Next, the testing algorithm commands the intake valve mechanism to induce a misfire in cylinder one. In the engine of the illustrated example, this is accomplished by retarding the intake valve closing timing to occur at about 105° before top dead center in the compression stroke combined with retarding injection timing for that cylinder by about 5°. Once this process is initiated, the engine is again allowed to settle. In the next following column with the letter "D", data is taken. A misfire will be detected if cylinders 2 and 3 show a substantial increase in the amount of fuel injected to maintain engine speed than that which was seen when cylinders 1, 2 and 3 were all in a powered mode. After the data is taken and stored, the engine is again commanded to operate cylinders 1, 2 and 3 in a powered mode with cylinders 4, 5 and 6 in a cut out mode. The testing algorithm then proceeds in a manner similar to that of cylinder 1 with regard to cylinder 2, and thereafter cylinder 3. Toward the middle of grid 50 the engine is again commanded to operate on all six cylinders before proceeding to test the variable intake valve actuators associated with cylinders 4, 5 and 6. After a settling period, cylinders 1, 2 and 3 are commanded to cut out, and the engine is commanded to maintain the predetermined engine speed with only cylinders 4, 5 and 6. Thereafter, the testing algorithm proceeds through the sequential settling time and data taking time periods associated with testing each of the remaining cylinders 4, 5 and 6. When the testing algorithm is completed, the engine returns to normal operation operating on all six cylinders.

The data retrieved during the testing algorithm can be stored in an electronic control module and/or displayed to an operator of the vehicle. Alternatively, the data could be taken or transferred to a servicing computer in a conventional manner.

The present invention is advantageous in having the ability to quickly and easily confirm whether a variable valve mechanism is operating properly. The desire to perform such a test can arise from a variety of means. For instance, the electronic control module fault indicator could detect that a variable valve mechanism associated with one of the engine cylinders is operating improperly. Instead of immediately replacing the suspected unit, a test according to the present invention could be performed in order to confirm that the fault indicator was accurate. In addition, the present invention allows for a quick determination as to whether a newly installed variable valve mechanism is operating properly. Thus, depending upon how the invention is implemented, the present invention can prevent unnecessary replacement of good variable valve mechanism, can provide a simple and inexpensive method of confirming a proper installation of a new variable valve mechanism, and can generally prevent or reduce costly down time and potential expenses associated with vehicle servicing.

It should be understood that the above description is intended for illustrative purposes only, and is not intended to limit the scope of the present invention in any way. Thus, those skilled in the art will appreciate that other aspects, objects, and advantages of the invention can be obtained from a study of the drawings, the disclosure and the appended claims.

What is claimed is:

1. A method of testing a variable valve mechanism for an internal combustion engine, comprising the steps of:

operating the engine;

inducing a misfire at least in part by commanding a change to a state of a variable valve mechanism at a predetermined timing in an engine cycle for a cylinder being supplied with fuel in said engine cycle; and detecting whether a misfire occurred.

2. The method of claim 1 wherein the inducing step includes a step of retarding an intake valve closing timing.

3. The method of claim 1 wherein the inducing step includes a step of retarding injection timing.

4. The method of claim 1 wherein the operating step includes a step of controlling the engine to operate at a predetermined speed; and the detecting step includes a step of detecting an injection quantity increase.

5. The method of claim 1 wherein the detecting step includes a step of detecting vibrational change from the engine.

6. The method of claim 1 wherein the inducing step includes a step of retarding an exhaust valve closing timing.

7. The method of claim 1 wherein the inducing step includes a step of reducing a maximum cylinder pressure.

8. The method of claim 1 wherein the inducing and detecting steps are performed sequentially on individual engine cylinders.

9. The method of claim 1 including a step of opening a valve via a cam rotation;

activating the variable valve mechanism before a cam dictated valve closing timing; and deactivating the variable valve mechanism at a timing that will reduce a maximum cylinder pressure.

10. The method of claim 1 including a step of logging an engine fault;

identifying an engine cylinder associated with the logged engine fault; and performing the inducing and detecting steps on the engine cylinder.

11. An electronic control module for an internal combustion engine comprising:

a computer readable data storage medium;

a variable valve mechanism testing algorithm recorded on the medium, and being operable to command a change to a state of a variable valve mechanism at a predetermined timing in an engine cycle for a cylinder being supplied with fuel in said engine cycle; and the testing algorithm including an engine cylinder misfire detection algorithm operable to detect a misfire in said engine cycle.

12. The electronic control module of claim 11 wherein said testing algorithm includes a valve closing timing retarding algorithm.

13. The electronic control module of claim 12 wherein said testing algorithm includes a fuel injection timing retarding algorithm.

14. The electronic control module of claim 11 wherein said misfire detection algorithm includes an injection quantity increase detection algorithm.

15. The electronic control module of claim 11 wherein said testing algorithm includes an engine cylinder selection algorithm; and a test result recording algorithm.

16. A machine comprising:

a chassis;

an engine mounted on said chassis and being equipped with at least one variable valve mechanism; and means for testing said variable valve mechanism that includes means for inducing an engine cylinder misfire at least in part by commanding a change to a state of the variable valve mechanism at a predetermined timing in an engine cycle for a cylinder being supplied with fuel in said engine cycle.

17. The machine of claim 16 wherein said means for testing includes an electronic control module having a variable valve mechanism testing algorithm.

18. The machine of claim 16 wherein said means for testing includes a diagnostic computer operably coupled to said engine.

* * * * *